US010406543B2

(12) United States Patent
Tabata et al.

(10) Patent No.: US 10,406,543 B2
(45) Date of Patent: Sep. 10, 2019

(54) SPRAYING APPARATUS

(71) Applicant: Panasonic Intellectual Property Management Co., Ltd., Osaka (JP)

(72) Inventors: Daisuke Tabata, Osaka (JP); Akira Isomi, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 76 days.

(21) Appl. No.: 15/391,835

(22) Filed: Dec. 27, 2016

(65) Prior Publication Data

US 2017/0203313 A1 Jul. 20, 2017

(30) Foreign Application Priority Data

Jan. 20, 2016 (JP) ..... 2016-008743

(51) Int. Cl.

*B05B 7/04* (2006.01)
*B05B 7/10* (2006.01)
*B05B 1/34* (2006.01)

(52) U.S. Cl.

CPC ..... *B05B 7/0483* (2013.01); *B05B 7/0458* (2013.01); *B05B 7/0475* (2013.01); *B05B 7/10* (2013.01); *B05B 1/3436* (2013.01)

(58) Field of Classification Search

CPC ..... B05B 7/0483; B05B 7/10; B05B 7/0475; B05B 7/0458; B05B 1/3436

USPC ..... 239/290, 296, 299, 419, 427, 424, 433, 239/545, 427.3, 431, 396, 432

See application file for complete search history.

(56) References Cited

U.S. PATENT DOCUMENTS 8,074,900 B2 * 12/2011 Brown ..... B05B 7/0466 239/429
9,168,545 B2 * 10/2015 Vidusek ..... B05B 7/10
2003/0052197 A1 * 3/2003 Bui ..... B05B 7/0475 239/416.4
2009/0305178 A1 12/2009 Nakagawa et al.
2010/0276507 A1 * 11/2010 Labegorre ..... B05B 7/0458 239/11
2013/0334342 A1 12/2013 Asakawa et al.

FOREIGN PATENT DOCUMENTS

DE 3943096 A1 * 7/1990 ..... F23D 11/10
JP 2001-149822 6/2001
JP 2008-045776 2/2008
JP 2012-223752 11/2012

OTHER PUBLICATIONS

DE3943096 A1 engliash translation.*

* cited by examiner

*Primary Examiner* — Alexander M Valvis
*Assistant Examiner* — Qingzhang Zhou
(74) *Attorney, Agent, or Firm* — Panasonic IP Management; Kerry S. Culpepper

(57) ABSTRACT

Spraying apparatus 10 includes: inner lid 13; outer lid 14; and gas-liquid mixing section 15 between inner lid 13 and outer lid 14, wherein a liquid is introduced into gas-liquid mixing section 15 from a position upstream and proximate outer lid plate 14*a* of outer lid 14, and a gas is introduced into gas-liquid mixing section 15 from an opposite position, the liquid is atomized in gas-liquid mixing section 15 by the liquid impinging with the gas and transforming into a gas-liquid mixed fluid, and advancing to spouting portion 16 as the gas-liquid mixed fluid is circulated along outer lid plate 14*a* of outer lid 14 in gas-liquid mixing section 15.

8 Claims, 4 Drawing Sheets

SPRAYING APPARATUS

BACKGROUND

1. Technical Field

The present disclosure relates to a two-fluid nozzle spraying apparatus which atomizes a liquid using a gas.

2. Description of the Related Art

Nozzles for atomizing liquids are widely used in, for example, space/material cooling apparatuses, humidifying apparatuses, chemical solution dispensing apparatuses, combustion apparatuses, and dust control apparatuses. The atomization nozzles can be broadly divided into a single-fluid nozzle and a two-fluid nozzle. The single-fluid nozzle atomizes a liquid by spouting the liquid from a micro aperture. The two-fluid nozzle atomizes a liquid, using a gas such as an air, nitrogen, steam, etc. Comparing the single-fluid nozzle and the two-fluid nozzle, in general, the two-fluid nozzle is superior to the single-fluid nozzle in atomization performance because the two-fluid nozzle atomizes a liquid using energy of a gas.

As an example of the two-fluid nozzle which atomizes a liquid, for example, Japanese Unexamined Patent Application Publication No. 2001-149822 (PTL 1) discloses a two-fluid nozzle. The two-fluid nozzle disclosed in PTL 1, as illustrated in FIG. 4, has a triple-barrel structure comprising inner barrel 40, middle barrel 41, and outer barrel 42. Inner barrel 40 is formed of proximal barrel 43 and distal barrel 44 coupled with each other. A hollow portion of inner barrel 40 is referred to as center air passageway 45. An annular intermediate passageway between inner barrel 40 and middle barrel 41 is referred to as liquid passageway 46. An annular outer passageway between middle barrel 41 and outer barrel 42 is referred to as outer air passageway 47. Proximal opening 47*a* of outer air passageway 47 and proximal opening 45*a* of center air passageway 45 are connected to an air supply main not shown. Thus, low pressure air from a pneumatic pressure source configured of a blower not shown is introduced into proximal opening 47*a* and proximal opening 45*a* via the air supply main. Proximal opening 46*a* of annular liquid passageway 46 is connected to a water supply main not shown. Pressurized water from a liquid reservoir not shown is introduced into proximal opening 46*a* via the water supply main and a pump.

Distal barrel 44 included in inner barrel 40, middle barrel 41, and outer barrel 42 include distal portions 40*b*, 41*b*, and 42*b*, respectively, at respective distal ends. Distal portions 40*b*, 41*b*, and 42*b* have openings 40*a*, 41*a*, 42*a*, respectively, which are positioned collinearly along axis L. Opening 41*a* of middle barrel 41 is positioned within opening 42*a* of outer barrel 42. Opening 42*a* is a spout. Opening 40*a* of inner barrel 40 is positioned within opening 41*a* of middle barrel 41.

In inner barrel 40, distal barrel 44 is screwed into and connected to proximal barrel 43. Inner barrel 40 has inner barrel opening 40*a* at the tip, and small-diameter orifice 44*a* formed in the center of distal barrel 44 in the direction of axis L. Generally opposed two recessed grooves 44*c* are formed in distal surface 44*b* which define the perimeter of opening 40*a* of inner barrel 40.

Distal portion 41*b* of middle barrel 41 has a conical external surface, and an internal surface having step 41*c*. Middle barrel 41 has, on the distal end side, a small-diameter hollow portion having a same diameter as and communicating with opening 40*a* of inner barrel 40. Middle barrel 41 has opening 41*a* at the tip. Opening 41*a* has a smaller diameter than the small-diameter hollow portion of middle barrel 41.

Step 41*c* in middle barrel 41 abuts distal surface 44*b* of inner barrel 40 such that step 41*c* and grooves 44*c* form three liquid swirling communication passageways 48. Liquid swirling communication passageways 48 open to a distal hollow portion of inner barrel 40 and communicating between the distal hollow portion of inner barrel 40 and a distal hollow portion of middle barrel 41. A distal hollow portion formed and communicating between inner barrel 40 and middle barrel 41 is referred to as first mixing chamber 49.

Distal portion 42*b* of outer barrel 42 is positioned widely spaced from distal portion 41*b* of middle barrel 41. Second mixing chamber 50 is formed between distal portion 41*b* of middle barrel 41 and distal portion 42*b* of outer barrel 42. Second mixing chamber 50 communicates with outer annular air passageway 47. Opening 42*a*, which is the spout, is located in the tip center of outer barrel 42.

In the nozzle as configured above, initially, water that enters liquid passageway 46 is swirled as it passes through liquid swirling communication passageways 48 and the swirl flow enters first mixing chamber 49. Thus, the water has been put through primary atomization by being swirled. The water that entered first mixing chamber 49 in a form of the swirl flow impinges and mixes with an air from a blower which has passed and spouted from orifice 44*a* of center air passageway 45. Thus, the water has been put through secondary atomization by impinging and mixing with the air, and a gas-liquid mixed fluid spouts from opening 41*a* of middle barrel 41 into second mixing chamber 50.

The gas-liquid mixed fluid resulted from the secondary atomization impinges and mixes, in second mixing chamber 50, with an air from a blower that enters through outer air passageway 47. A gas-liquid mixed mist resulted from the tertiary atomization in this manner in second mixing chamber 50 is sprayed through opening 42*a*, which is the spout, of outer barrel 42. In particular, owing to second mixing chamber 50 being a large space, the air that entered second mixing chamber 50 through outer air passageway 47 uniformly impinges and mixes with the gas-liquid mixed fluid that entered through opening 41*a* and the gas-liquid mixed fluid is also swirled, thereby uniformly atomizing water droplets (see PTL 1).

SUMMARY

However, a problem with the configuration of the conventional two-fluid nozzle disclosed in PTL 1 is that, despite of the complex nozzle structure, the liquid to be sprayed is not sufficiently atomized, ending up spraying a liquid having a large particle size. Specifically, the liquid sprayed through the two-fluid nozzle disclosed in PTL 1 has a particle size of 50 μm or greater. The liquid sprayed having a large particle size as such requires time to vaporize. In other words, an object sprayed with the liquid gets dripping wet due to late vaporization.

The present disclosure solves the conventional problem and has an object to provide a spraying apparatus which sprays liquid which has a small particle size and vaporize so quickly that an object sprayed with the liquid does not get dripping wet. More specifically, the object of the present disclosure is to provide a two-fluid nozzle spraying apparatus which sprays a liquid which has a small particle size such as 10 μm or less and vaporizes so quickly that an object sprayed with the liquid do not get dripping wet.

In order to achieve the above object, according to one aspect of the present disclosure, a spraying apparatus is provided which includes: a spraying apparatus main body having a liquid passageway and a gas passageway; an inner lid which includes an inner lid plate, the inner lid being disposed on a distal end of the spraying apparatus main body and covering an opening of the liquid passageway, the inner lid plate being flat; an outer lid which includes an outer lid plate which is flat and faces the inner lid plate of the inner lid, the outer lid being disposed on the distal end of the spraying apparatus main body and covering the inner lid and an opening of the gas passageway; a gas-liquid mixing section for mixing a gas that enters through the gas passageway and a liquid that enters through the liquid passageway, the gas-liquid mixing section being a space between the inner lid and the outer lid and having a disc-shaped profile defined by the inner lid plate of the inner lid and the outer lid plate of the outer lid; a liquid inlet for introducing the liquid into the gas-liquid mixing section, the liquid inlet passing through the inner lid plate of the inner lid in an edge portion of the inner lid plate and communicating with the gas-liquid mixing section; a gas inlet for introducing the gas into the gas-liquid mixing section to the liquid that entered the gas-liquid mixing section through the liquid inlet, the gas inlet communicating with the gas-liquid mixing section; and a spout for spouting a liquid atomized by the gas and the liquid being mixed in the gas-liquid mixing section, the spout communicating with the gas-liquid mixing section and passing through the outer lid plate of the outer lid.

As such, according to the spraying apparatus of the above aspect of the present disclosure, the spraying apparatus is provided which sprays a liquid which has a small particle size and vaporizes so quickly that an object sprayed with the liquid does not get dripping wet. More specifically, the two-fluid nozzle spraying apparatus can be provided which sprays a liquid which has a small particle size such as 10 μm or less and vaporizes so quickly that an object sprayed with the liquid do not get dripping wet.

DETAILED DESCRIPTION

Hereinafter, embodiments according to the present disclosure are described with reference to the accompanying drawings.

The embodiments relate to a spraying apparatus which atomizes and sprays a liquid using a gas. Examples of the gas include an air, nitrogen, oxygen, and inert gas. The gas for use may be selected appropriately, according to an intended use of the spraying apparatus. Examples of the liquid include water, ozonated water, chemical solutions having bactericiding and disinfecting capabilities, paints, and fuel oils. The liquid for use may be selected appropriately, according to an intended use of the spraying apparatus.

Embodiment 1

Figure 1A:
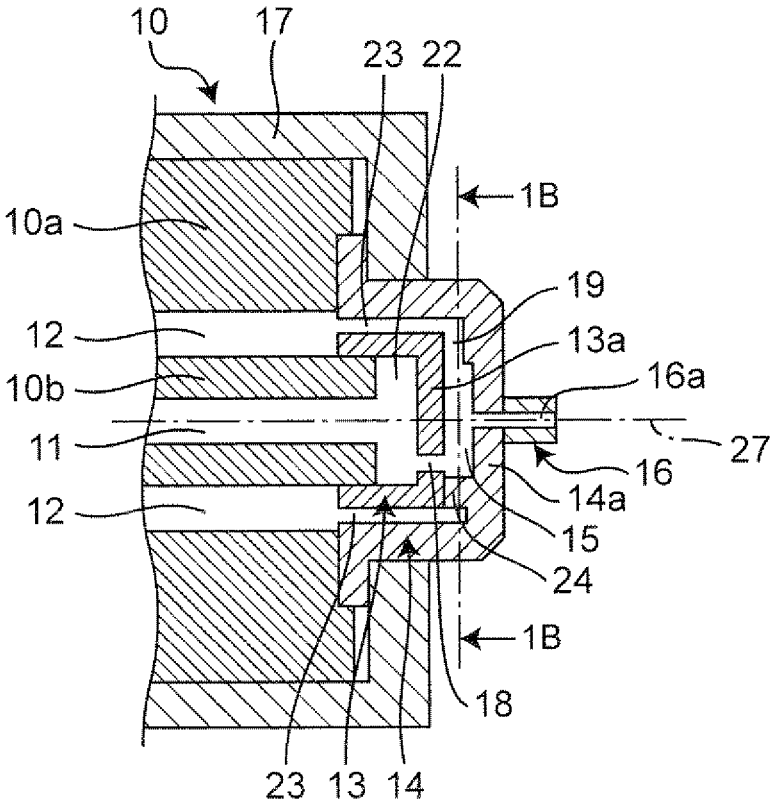
FIG. 1A is a cross-sectional end view of a spraying apparatus according to Embodiment 1 of the present disclosure.
Figure 1B:
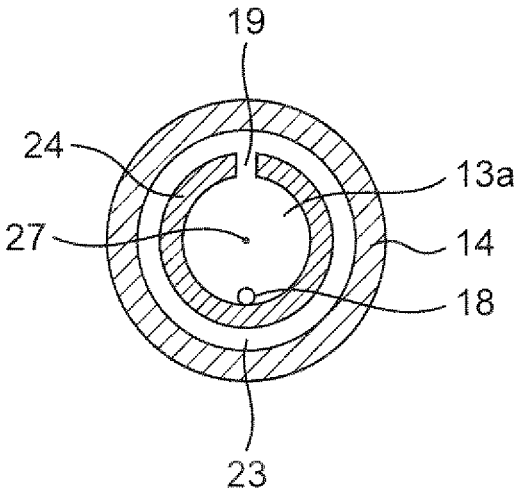
FIG. 1B is a cross-sectional view of the spraying apparatus according to Embodiment 1, taken along a line 1B-1B in FIG. 1A.

FIG. 1A is a cross-sectional end view of spraying apparatus 10 according to Embodiment 1 of the present disclosure. FIG. 1B is a cross-sectional view of spraying apparatus 10 according to Embodiment 1, taken along a line 1B-1B in FIG. 1A. In the following, configuration of spraying apparatus 10 is described with reference to FIGS. 1A and 1B.

Spraying apparatus 10 includes, at least, spraying apparatus main body 10*a*, inner lid 13, and outer lid 14. Inner lid 13 and outer lid 14 form gas-liquid mixing section 15. Spraying apparatus 10 further includes spraying apparatus lid securing part 17.

Spraying apparatus main body 10*a* is a cylindrical member and has liquid passageway 11 and gas passageway 12. Liquid passageway 11 is formed along the direction of central axis 27. Gas passageway 12 is in a cylindrical shape and formed spaced from and around liquid passageway 11 along the direction of central axis 27. Liquid passageway 11 and gas passageway 12 are partitioned by cylinder 10*b* which is a portion of spraying apparatus main body 10*a* and located in the middle. Only the distal end side of liquid passageway 11 is shown. A liquid supply port not shown is provided at the proximal end of liquid passageway 11, and is, for example, connected via a water supply conduit to a pump connected to a liquid reservoir. Only the distal end side of gas passageway 12 is shown. A gas supply port not shown is provided at the proximal end of gas passageway 12, and is, for example, connected via a gas supply conduit to a pneumatic pressure source configured of an air compressor.

The tip of cylinder 10*b* projects to the distal end side of spraying apparatus 10 slightly more than the portion of spraying apparatus main body 10*a* not including cylinder 10*b*. Inner lid 13 is secured to cylinder 10*b*.

Inner lid 13 covers the opening of liquid passageway 11. Inner lid 13 includes flat inner lid plate 13*a* and has a generally C-shaped cross section. First space 22 is disc-shaped and formed between an end face of cylinder 10*b* and the internal surface of inner lid plate 13*a* of inner lid 13. Liquid inlet 18 is passing through inner lid plate 13*a* of inner lid 13 along the direction of central axis 27, in an edge portion of inner lid plate 13*a*. In other words, liquid inlet 18 is located proximate the inner surface of annular projection 24, and communicating between liquid passageway 11 and gas-liquid mixing section 15.

Outer lid 14 is disposed on the tip of spraying apparatus main body 10*a*, covering inner lid 13 and the opening of gas passageway 12. Outer lid 14 has a generally Ω-shaped cross section and includes flat outer lid plate 14*a* facing inner lid plate 13*a* of inner lid 13. Outer lid 14 is securely sandwiched between an end face of spraying apparatus main body 10*a* and spraying apparatus lid securing part 17 such that (i) second space 23 in a cylindrical profile is formed uniform between outer lid 14 and inner lid 13, and (ii) gas-liquid mixing section 15 in a disc-shaped profile, which is the space, is formed uniform between outer lid plate 14*a* and inner lid plate 13*a*. It should be noted that spraying apparatus lid securing part 17 may be omitted, and outer lid 14 may instead be secured directly to the end face of spraying apparatus main body 10*a*.

In order to securely form gas-liquid mixing section 15 in the disc-shaped profile and uniform between outer lid 14 and inner lid 13, annular projection 24 is formed on an internal surface, which faces inner lid plate 13*a*, of outer lid plate 14*a*, so as to form gas-liquid mixing section 15, which is the space, between outer lid plate 14*a* of outer lid 14 and inner lid plate 13*a* of inner lid 13. Annular projection 24 may be formed on an external surface, which is facing outer lid plate 14*a*, of inner lid plate 13*a*, instead of being formed on the internal surface of outer lid plate 14*a* of outer lid 14. Gas-liquid mixing section 15 thus configured is for mixing gas that enters through gas passageway 12 and liquid that enters through liquid passageway 11.

Moreover, gas inlet 19 communicating between gas passageway 12 and gas-liquid mixing section 15 is formed in a portion of annular projection 24. Thus, gas inlet 19 is disposed such that a flow of the liquid out of liquid inlet 18 and a flow of the gas out of gas inlet 19 intersect. Gas inlet 19 is located 180 degrees from liquid inlet 18 about the center (central axis 27) of spraying apparatus main body 10*a*. Stated differently, gas inlet 19 and liquid inlet 18 are located on opposite sides relative to the center (central axis 27) of spraying apparatus main body 10*a*. Further, spouting portion 16 in a cylindrical shape is formed projecting from and secured to the center of the external surface of outer lid plate 14*a* of outer lid 14. Spouting portion 16 has spout 16*a* passing through outer lid plate 14*a* along the direction of central axis 27. Spout 16*a* is formed on central axis 27, as with liquid passageway 11. Liquid inlet 18, on the other hand, is located offset from central axis 27.

Thus, gas-liquid mixing section 15 is defined by annular projection 24, inner lid 13, and outer lid 14, and communicating between: liquid inlet 18 passing through inner lid 13 along the direction of central axis 27; gas inlet 19 formed in annular projection 24 and extends along the direction intersecting with the direction of central axis 27; and spout 16*a* passing through outer lid 14 along the direction of central axis 27.

In such a configuration, liquid supplied to spraying apparatus 10 enters spraying apparatus main body 10*a* through the liquid supply port not shown, transforms into a liquid flow as it flows through liquid passageway 11 toward the distal end of spraying apparatus 10, and the liquid flow passes through first space 22 and liquid inlet 18 and is supplied into gas-liquid mixing section 15. Gas supplied to spraying apparatus 10 enters spraying apparatus main body 10*a* through the gas supply port not shown, transforms into a gas flow as it flows through gas passageway 12 toward the distal end of spraying apparatus 10, and the gas flow passes through second space 23 and gas inlet 19 and is supplied into gas-liquid mixing section 15.

The gas and liquid supplied in gas-liquid mixing section 15 are mixed together, thereby atomizing the liquid into a gas-liquid mixed mist. The gas-liquid mixed mist then spouts from spout 16*a* of spouting portion 16 on outer lid 14.

In the following, the mechanism for atomizing the liquid in gas-liquid mixing section 15 is described. The liquid through liquid passageway 11 passes through first space 22 and passes through liquid inlet 18 formed in inner lid 13, enters gas-liquid mixing section 15 along annular projection 24, and flows in parallel to inner lid plate 13*a* of inner lid 13 toward spouting portion 16.

Meanwhile, the gas passes through gas inlet 19 facing liquid inlet 18 across central axis 27, and is supplied in gas-liquid mixing section 15. The gas impinges, in gas-liquid mixing section 15, with the liquid supplied from liquid inlet 18. The liquid impinged with the gas as such spreads out to outer lid plate 14*a* of outer lid 14 and transforms into a thin film, and the thin film of liquid flows along outer lid plate 14*a*. The thin film of liquid further flows along outer lid plate 14*a* in the circumferential direction of annular projection 24, and thereby further transforms from the thin film to fine water droplets. Still further, a gas-liquid mixed fluid comprising the water droplets is circulated and aggregated along the wall surface which is the internal surface of outer lid plate 14*a* of outer lid 14 in gas-liquid mixing section 15. As a result, the water droplets can further be atomized, allowing a liquid having a small particle size to be sprayed from spout 16*a*.

More specifically, spraying apparatus 10 is a spraying apparatus which includes: gas-liquid mixing section 15 having a diameter of 8.0 mm and a height of 2.0 mm; spouting portion 16 which has spout 16*a* having a diameter of 1.5 mm and a length of 2.0 mm; liquid inlet 18 having a diameter of 0.7 mm; and gas inlet 19 rectangular in shape and having a width of 1.0 mm and a height of 1.0 mm.

The spraying apparatus was supplied with a compressed air, which is an example of the gas, pressurized by 0.2 MPa (gauge pressure) and a water, which is an example of the liquid, pressurized by 0.15 MPa (gauge pressure). A Sauter mean diameter of the water atomized under the above conditions was evaluated by a laser diffraction technique. A measurement according to the laser diffraction technique was carried out on atomized water 300 mm away from the tip of the spraying apparatus, and Sauter mean diameter evaluated was 10.0 μm.

According to spraying apparatus 10 of Embodiment 1, in gas-liquid mixing section 15 between inner lid 13 and outer lid 14, gas through gas inlet 19 impinges in a vertically downward direction with liquid through liquid inlet 18, by which the liquid is circulated and aggregated along annular projection 24 and atomized, thereby allowing the atomized liquid to be spout from spouting portion 16. As a result, spraying apparatus 10 is provided which sprays a liquid which has a small particle size and vaporizes so quickly that an object sprayed with the liquid does not get dripping wet. More specifically, two-fluid nozzle spraying apparatus 10 is provided which sprays a liquid which has a small particle size such as 10 μm or less and vaporizes so quickly that an object sprayed with the liquid do not get dripping wet.

Embodiment 2

Figure 2A:
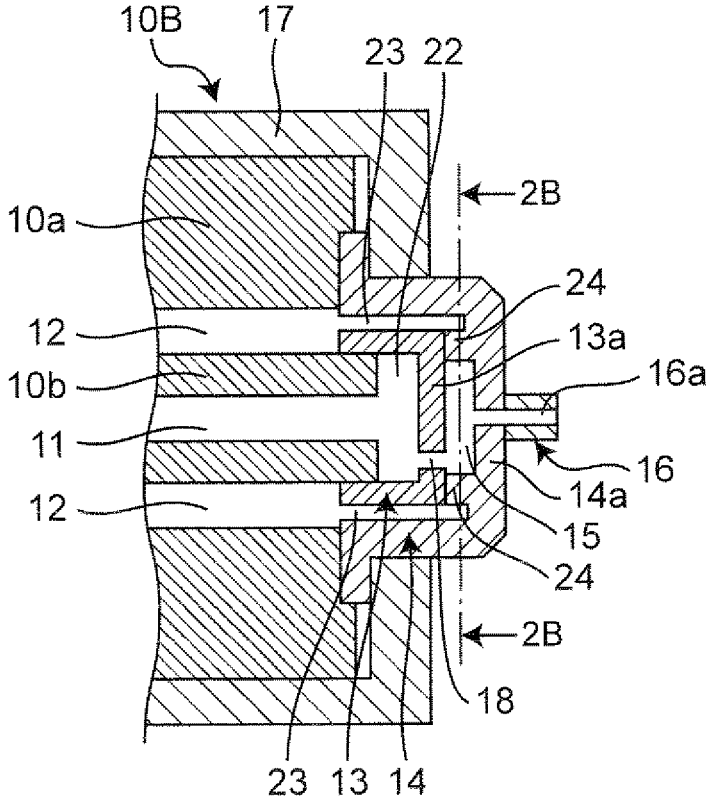
FIG. 2A is a cross-sectional end view of a spraying apparatus according to Embodiment 2 of the present disclosure.
Figure 2B:
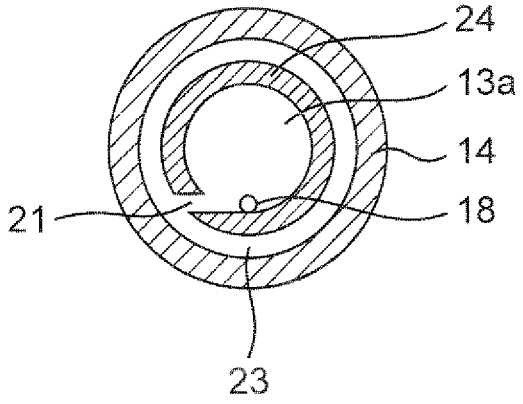
FIG. 2B is a cross-sectional view of the spraying apparatus according to Embodiment 2, taken along a line 2B-2B in FIG. 2A.

FIG. 2A is a cross-sectional end view of spraying apparatus 10B according to Embodiment 2 of the present disclosure. FIG. 2B is a cross-sectional view of spraying apparatus 10B according to Embodiment 2, taken along a line 2B-2B in FIG. 2A.

As illustrated in FIGS. 2A and 2B, a liquid passes through liquid inlet 18 proximate the peripheral wall surface of annular projection 24 on outer lid 14, enters gas-liquid mixing section 15, and flows in parallel to inner lid plate 13*a* of inner lid 13 toward spouting portion 16. Gas inlet 21 is formed in a portion of annular projection 24 at a position proximate liquid inlet 18. Gas inlet 21 extends in a direction perpendicular to the central axis of liquid inlet 18 in a manner, as illustrated in FIG. 2B, that the inner periphery of annular projection 24 in a cross-section is tangentially to liquid inlet 18. Thus, the gas is introduced into gas-liquid mixing section 15 and the liquid and the gas impinge with each other into a gas-liquid mixed fluid, and the gas-liquid mixed fluid is circulated in a circumferential direction along the peripheral wall surface of annular projection 24. Stated differently, gas inlet 21 is located proximate liquid inlet 18 in a manner that a flow of the liquid out of liquid inlet 18 and a flow of the gas out of gas inlet 21 intersect. The configuration as such introduces the gas through gas inlet 21 into gas-liquid mixing section 15 in a direction (e.g., tangential direction of the peripheral wall surface of annular projection 24) lateral to a direction in which the liquid is introduced into gas-liquid mixing section 15 and causes the gas to laterally impinge with the liquid, thereby causing the liquid to spread out to outer lid plate 14*a* of outer lid 14 and transforms into a thin film, and the thin film of liquid flows along outer lid plate 14*a*. The thin film of liquid further flows along outer lid plate 14*a* in the circumferential direction of annular projection 24, and thereby further transforms from the thin film to fine water droplets. Still further, a gas-liquid mixed fluid comprising the water droplets is circulated and aggregated along outer lid plate 14*a* of outer lid 14 in gas-liquid mixing section 15. As a result, the water droplets can further be atomized, allowing a liquid having a small particle size to be sprayed from spout 16*a*.

More specifically, the spraying apparatus was supplied with a compressed air, which is an example of the gas, pressurized by 0.2 MPa (gauge pressure) and a water, which is an example of the liquid, pressurized by 0.15 MPa (gauge pressure). In the above conditions, the water was atomized. A Sauter mean diameter of the water in the above state atomized under the above conditions was evaluated by a laser diffraction technique. A measurement according to the laser diffraction technique was carried out on atomized water 300 mm away from the tip of the spraying apparatus, and Sauter mean diameter evaluated was 9.6 μm. As can be seen from the result, compared to liquid inlet 18 and gas inlet 19 located facing each other, liquid inlet 18 and gas inlet 21 located proximate to each other yielded better advantageous effects of aggregating the gas-liquid mixed fluid and atomizing the water.

According to such a configuration, gas inlet 21 is formed in a portion of annular projection 24 at a position proximate liquid inlet 18, and extends in a direction perpendicular to the central axis of liquid inlet 18 in a manner, as illustrated in FIG. 2B, that the inner periphery of annular projection 24 in a cross-section is tangentially to liquid inlet 18. Owing to this, the gas through gas inlet 21 is introduced into gas-liquid mixing section 15 in a direction (e.g., the tangential direction of the peripheral wall surface of annular projection 24) laterally to a direction in which the liquid is introduced into gas-liquid mixing section 15 and is caused to laterally impinge with the liquid in gas-liquid mixing section 15, thereby further facilitating the flow of gas-liquid mixed fluid in the circumferential direction of annular projection 24 on outer lid plate 14*a*. This further facilitates the gas-liquid mixed fluid to flow and thus further circulated and aggregated along outer lid plate 14*a* in the circumferential direction of annular projection 24. As a result, the water droplets can further be atomized, allowing a liquid having a small particle size to be sprayed from spout 16*a*.

Embodiment 3

Figure 3A:
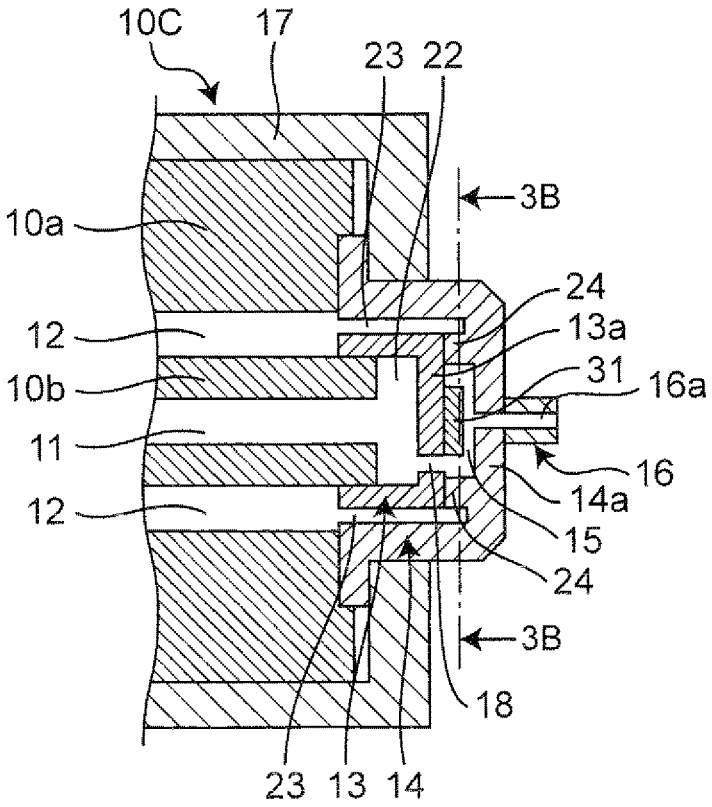
FIG. 3A is a cross-sectional end view of a spraying apparatus according to Embodiment 3 of the present disclosure.
Figure 3B:
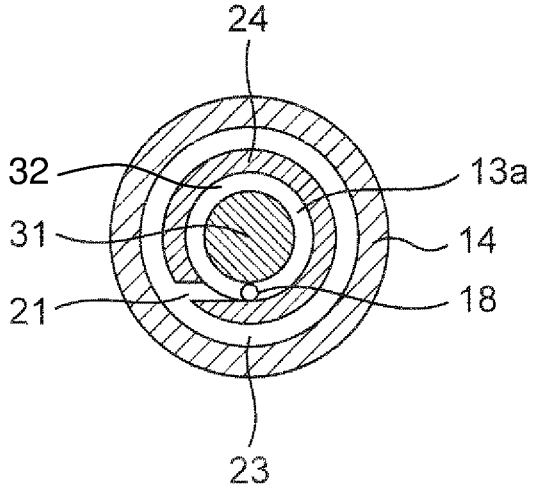
FIG. 3B is a cross-sectional view of the spraying apparatus according to Embodiment 3, taken along a line 3B-3B in FIG. 3A.
Figure 4:
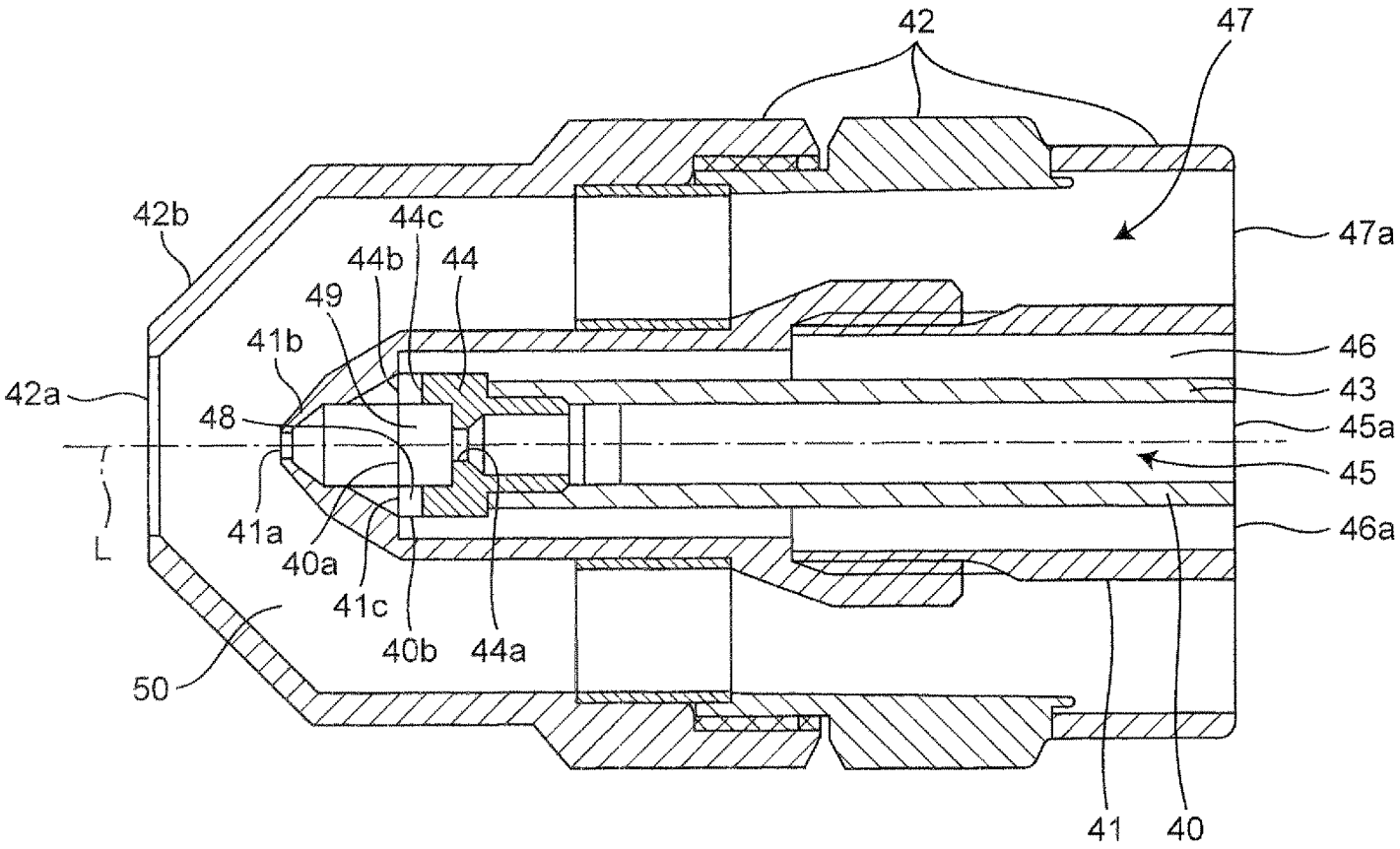
FIG.4 PRIOR ART
FIG. 4 is a cross-sectional view showing a schematic illustration of a conventional spraying apparatus.

FIG. 3A is a cross-sectional end view of spraying apparatus 10C according to Embodiment 3. FIG. 3B is a cross-sectional view of the spraying apparatus according to Embodiment 3, taken along a line 3B-3B in FIG. 3A.

As illustrated in FIGS. 3A and 3B, as with Embodiment 2, a liquid passes through liquid inlet 18 proximate the peripheral wall surface of outer lid plate 14*a* of outer lid 14, enters gas-liquid mixing section 15, and flows in parallel to inner lid plate 13*a* of inner lid 13 toward spouting portion 16. Also as with Embodiment 2, gas inlet 21 is formed in a portion of annular projection 24 at a position proximate liquid inlet 18. Gas inlet 21 extends in a direction perpendicular to the central axis of liquid inlet 18 in a manner, as illustrated in FIG. 3B, that the inner periphery of annular projection 24 in a cross-section is tangentially to liquid inlet 18. Thus, the gas is introduced into gas-liquid mixing section 15 and the liquid and the gas impinge with each other and transform into a gas-liquid mixed fluid, and the gas-liquid mixed fluid is circulated in a circumferential direction along the peripheral wall surface of annular projection 24.

Further, in Embodiment 3, disc-shaped projection 31 is formed on inner lid plate 13*a* of inner lid 13 in gas-liquid mixing section 15. Disc-shaped projection 31 is located proximate liquid inlet 18 and has a width in a direction perpendicular to the line 3B-3B less than a width of gas-liquid mixing section 15 in the direction. This forms annular passageway 32 between disc-shaped projection 31 and annular projection 24, thereby regulating the flow of gas and the flow of the gas-liquid mixed fluid in the circumferential direction. This results in an increased flow rate. It should be noted that projection 31 has a thickness at least half the height of gas-liquid mixing section 15.

The accelerated flow of gas transforms the liquid into a thin film, and the thin film of liquid flows along outer lid plate 14*a*. The thin film of liquid further flows along outer lid plate 14*a* in the circumferential direction of annular projection 24, and thereby further transforms from the thin film into fine water droplets. Still further, a gas-liquid mixed fluid comprising the water droplets is circulated and aggregated at high speed along annular passageway 32 formed between projection 31, annular projection 24, and outer lid 14 of outer lid plate 14*a* in gas-liquid mixing section 15, thereby further facilitating the atomization of the liquid. This allows a liquid having a smaller particle size to be sprayed.

More specifically, projection 31 is formed on the surface, in which liquid inlet 18 is formed, of gas-liquid mixing section 15. Projection 31 has a diameter of 1.5 mm and a height of 1.5 mm, and located in the center of gas-liquid mixing section 15.

The spraying apparatus was supplied with a compressed air, which is an example of the gas, pressurized by 0.2 MPa (gauge pressure) and a water, which is an example of the liquid, pressurized by 0.15 MPa (gauge pressure). A Sauter mean diameter of the water atomized under the above conditions was evaluated by a laser diffraction technique. A measurement according to the laser diffraction technique was carried out on atomized water 300 mm away from the tip of the spraying apparatus, and Sauter mean diameter evaluated was 9.1 μm.

As the result indicates, the liquid is further atomized by further aggregating the gas-liquid mixed fluid along projection 31 and outer lid plate 14*a* of outer lid 14 in gas-liquid mixing section 15.

According to Embodiment 3, disc-shaped projection 31 is disposed on inner lid plate 13*a* of inner lid 13 in gas-liquid mixing section 15, and annular passageway 32 is formed between disc-shaped projection 31 and annular projection 24. As a result, the flow of gas and the flow of gas-liquid mixed fluid are regulated in the circumferential direction of annular passageway 32, thereby increasing the flow rate.

This better facilitates the atomization of the liquid and allows a liquid having a smaller particle size to be sprayed.

Among the various embodiments described above, any embodiments may be combined as appropriate to yield the advantageous effects of the respective embodiments. In addition to combining any embodiments, features of the different embodiments may be combined.

The spraying apparatus according to the above aspect of the present disclosure is a spraying apparatus which sprays a liquid which has a small particle size such as about 10 μm and vaporizes so quickly that an object sprayed with the liquid does not get dripping wet. The spraying apparatus according to the above aspect of the present disclosure is widely applicable, for example, to cooling a space or material, humidifying, dispensing a chemical solution, combustion, or dust control.

What is claimed is:

1. A spraying apparatus comprising:

a spraying apparatus main body having a liquid passageway and a gas passageway;

an inner lid which includes an inner lid plate, the inner lid being disposed on a distal end of the spraying apparatus main body and covering an opening of the liquid passageway, the inner lid plate being flat;

an outer lid which includes an outer lid plate which is flat and faces the inner lid plate of the inner lid, the outer lid being disposed on the distal end of the spraying apparatus main body and covering the inner lid and an opening of the gas passageway;

a gas-liquid mixing section for mixing a gas that enters through the gas passageway and a liquid that enters through the liquid passageway, the gas-liquid mixing section being a space between the inner lid plate of the inner lid and the outer lid plate of the outer lid and having a disc-shaped profile defined by the inner lid plate of the inner lid and the outer lid plate of the outer lid;

a liquid inlet formed at the inner lid plate for introducing the liquid into the gas-liquid mixing section, the liquid inlet passing through the inner lid plate of the inner lid in an edge portion of the inner lid plate and communicating with the gas-liquid mixing section;

a gas inlet which is formed in a tangential direction of the gas-liquid mixing section and introduces the gas into the gas-liquid mixing section to the liquid that entered the gas-liquid mixing section through the liquid inlet, the gas inlet communicating with the gas-liquid mixing section; and a spout for spouting a liquid atomized by the gas and the liquid being mixed in the gas-liquid mixing section, the spout communicating with the gas-liquid mixing section and passing through the outer lid plate of the outer lid, wherein the gas inlet and the liquid inlet are aligned in a cross-sectional view in a vertical direction.

2. The spraying apparatus according to claim 1, wherein one of the outer lid plate of the outer lid and the inner lid plate of the inner lid has an annular projection, and the annular projection, the outer lid plate of the outer lid, and the inner lid plate of the inner lid form the gas-liquid mixing section, and the gas inlet is formed in a portion of the annular projection.

3. The spraying apparatus according to claim 1, wherein the gas inlet and the liquid inlet are located on opposite sides relative to a center of the spraying apparatus main body.

4. The spraying apparatus according to claim 2, wherein the gas inlet and the liquid inlet are located on opposite sides relative to a center of the spraying apparatus main body.

5. The spraying apparatus according to claim 1, wherein a flow of the liquid through the liquid inlet and a flow of the gas through the gas inlet intersect each other by disposing the gas inlet near the liquid inlet.

6. The spraying apparatus according to claim 2, wherein a flow of the liquid through the liquid inlet and a flow of the gas through the gas inlet intersect each other by disposing the gas inlet near the liquid inlet.

7. The spraying apparatus according to claim 5, wherein a projection in a disc shape is formed on the inner lid plate of the inner lid to form an annular passageway around the projection in the gas-liquid mixing section.

8. The spraying apparatus according to claim 6, wherein a projection in a disc shape is formed on the inner lid plate of the inner lid to form an annular passageway around the projection in the gas-liquid mixing section.

* * * * *